US008690610B2

(12) United States Patent
Shimizu

(10) Patent No.: US 8,690,610 B2
(45) Date of Patent: Apr. 8, 2014

(54) JOINT CONNECTOR WITH A PLURALITY OF TERMINALS, A HOUSING, AND A SPRING

(75) Inventor: Tomohiko Shimizu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 40 days.

(21) Appl. No.: 13/398,935

(22) Filed: Feb. 17, 2012

(65) Prior Publication Data

US 2012/0214352 A1 Aug. 23, 2012

(30) Foreign Application Priority Data

Feb. 18, 2011 (JP) ..... 2011-033709
Feb. 18, 2011 (JP) ..... 2011-033710

(51) Int. Cl.
*H01R 9/22* (2006.01)

(52) U.S. Cl.
USPC ..... 439/708; 439/721

(58) Field of Classification Search
USPC ..... 439/708, 709, 721
See application file for complete search history.

(56) References Cited

U.S. PATENT DOCUMENTS 4,952,155 A * 8/1990 Kuzuno et al. ..... 439/49
5,356,302 A * 10/1994 Inoue et al. ..... 439/189
5,769,650 A 6/1998 Aoyama et al.

FOREIGN PATENT DOCUMENTS

JP 8-250185 A 9/1996

OTHER PUBLICATIONS

Office Action, dated Jan. 6, 2014, issued by the Chinese Patent and Trade Mark Office in counterpart Chinese Patent Application No. 201210037880.0.

* cited by examiner

*Primary Examiner* — Hae Moon Hyeon
(74) *Attorney, Agent, or Firm* — Sughrue Mion, PLLC

(57) ABSTRACT

A joint connector comprises a plurality of terminals, a housing having a space with a size such that the plurality of terminals is capable of being accommodated in a contact state in parallel, and a terminal insertion slot allowing the terminals inserted into the space to be laterally moved from the side of one side wall to the opposite side wall, and a spring interposed between a terminal close to the one side wall among the plurality of terminals accommodated in the space, and the one side wall to press the plurality of terminals in a mutual contact state toward the opposite side wall.

7 Claims, 19 Drawing Sheets

JOINT CONNECTOR WITH A PLURALITY OF TERMINALS, A HOUSING, AND A SPRING

BACKGROUND OF THE INVENTION

1. Field of the Invention

The present invention relates to a joint connector, and particularly, to a joint connector that has a small number of parts, has a favorable assembling workability, has a small insertion force when terminals are accommodated within a housing, and a larger holding force for the terminals.

2. Description of the Related Art

<Exclusive Bus Bar>

As joint connectors, for example, joint connectors using exclusive bus bars as shown in FIGS. 10A to 10C are suggested. FIGS. 18A to 18C are conceptual diagrams of joint connectors in which each exclusive bus bar is inserted into a plurality of terminals to perform electrical connection; FIG. 18A shows an example of two terminals, FIG. 18B shows an example of three terminals, and FIG. 18C shows an example of five terminals. In FIGS. 18A to 18C when only terminals a and b among respective terminals a to e of wiring lines 1*a* to 1*e* are connected together, an exclusive bus bar 3A shown in FIG. 18A is inserted into the terminals a and b to connect both the terminals together.

Additionally, in a joint connector that connects terminals a to c among the respective terminals a to e of the wiring lines 1*a* to 1*e* together, an exclusive bus bar 3B shown in FIG. 18B is inserted into the terminals a to c to connect these terminals together.

Moreover, in a joint connector shown in FIG. 18C, an exclusive bus bar 3C is inserted into the terminals a to e to perform connection when the terminals a to e are connected together.

(Well-Known Example of Joint Connector Including Exclusive Bus Bar)

FIG. 19 is an exploded perspective view of a well-known joint connector (refer to Patent Document 1) using an exclusive bus bar that commonly connects three terminals shown in FIG. 18B. In FIG. 19, a housing 41 of a female connector 40 is a housing of a female connector molded from a synthetic resin material, and a waterproofing seal 44 and a retainer 45 are accommodated inside the housing. Moreover, three terminal accommodating chambers are formed side by side from the retainer 45, and a female terminal fitting 43 to which a covered electric wire 42 is connected is inserted into each terminal accommodating chamber.

A cap 50 is fitted to a front end of the housing 41. The cap 50 is also molded from a synthetic resin material, a cap body 51 has a shape capable of being fitted to the housing 41, and a top face portion of the cap body is formed with an engaging frame 51K capable of entering a lock arm 41K of the housing 41.

An exclusive bus bar 52 shown in FIG. 18B is integrally provided by insert molding within the cap 50. The exclusive bus bar 52 is formed by press-forming a metal plate, and has three male tab portions 52T in one horizontal row capable of being inserted into the terminal fittings 43 within the housing 41. Thus, when the cap body 51 and the housing 41 are brought into a fitting state, the exclusive bus bar 52 is brought into a connection state with the three terminal fittings 43 to electrically connect the respective terminal fittings to each other.

Patent Document 1: JP-A-8-250185

<Problems of Joint Connector of Patent Document 1>

In the joint connector of Patent Document 1, as shown in FIG. 19, the cap body 51, the exclusive bus bar 52, the waterproofing seal 44, and the retainer 45 are indispensable, and there is a problem in that the number of parts increases.

Additionally, the structure of preventing knocking of the tab portions of the bus bar is required when the cap body and the housing fits to each other.

Moreover, in order to increase the holding force of the terminals (that is, to ensure prevention of slip-out of the terminals from the housing), strong engagement is required, and this requires a large insertion force when the terminals are accommodated in the housing.

Additionally, the structure for preventing half-insertion of the terminals is also required.

SUMMARY OF THE INVENTION

The invention has been made to solve the above drawbacks, and an object thereof is to provide a joint connector in which only a small number of parts are required, and there is no concern about knocking of tab portions of a bus bar, a terminal holding force is large (slip-out prevention), and the insertion force when accommodating terminals within a housing is small, and half-insertion of the terminals is simply prevented.

The invention has been made in order to solve the above problems, and a first invention of the present application is a joint connector including a plurality of terminals, a housing having a space with a size such that the plurality of terminals is capable of being accommodated in a contact state in parallel, and a terminal insertion slot allowing the terminals inserted into the space to be laterally moved from the side of one side wall to the opposite side wall, and a spring interposed between a terminal close to the one side wall among the plurality of terminals accommodated in the space, and the one side wall to press the plurality of terminals in a mutual contact state toward the opposite side wall.

Additionally, a second invention of the present application is the joint connector of the first invention of the present invention in which the terminal includes a concave portion at a lower portion thereof in side view, the locking member is a long body with a convex cross-section that enters the concave portion, and the locking member is formed at the bottom of the housing so that, if the terminal is laterally moved in a state where the terminal is inserted into the space of the housing from the terminal insertion slot and abuts on a regulating surface, the locking member can enter the concave portion and the terminals can be laterally moved from the side of an inner wall surface of the one side wall to an inner wall surface of the opposite side wall.

A third invention of the present application is the joint connector of the second invention of the present invention in which a groove having almost the same width as the breadth of the terminal is formed along one side wall at the bottom of the housing.

Moreover, a fourth invention of the present invention relates to the joint connector of the third invention of the present invention in which the regulating surface that regulates the tip position of the terminal is formed as an inner wall surface of a back wall of the housing.

A fifth invention of the present application relates to a joint connector including a plurality of terminals, a housing having an internal space with a size such that the plurality of terminals is capable of being accommodated in a contact state in parallel, and a terminal insertion slot with a size allowing the terminals coupled to the internal space, a movable lance formed at a bottom of the housing so as to be capable of retreating from the bottom of the housing and returning to the bottom, and a spring interposed between a terminal close to the one side wall among the plurality of terminals accommodated in the internal space, and the one side wall to press the plurality of terminals in a mutual contact state toward the opposite side wall.

Additionally, a sixth invention of the present application relates to the joint connector of the first invention of the present invention in which the terminal includes a concave portion at a lower portion thereof in side view, the movable lance includes a convex portion having a convex cross-section that enters the concave portion, and the movable lance is formed at the bottom of the housing so that the convex portion of the movable lance can enter the concave portion of the terminal in a state where the terminal is inserted into the internal space of the housing from the terminal insertion slot and abuts on a regulating surface.

Moreover, a seventh invention of the present application relates to the joint connector of the second invention of the present invention in which the regulating surface that regulates the tip position of the terminal is formed as an inner wall surface of a back wall of the internal space.

(1) According to the above configuration, since a terminal is merely passed through a groove having the same width as the breadth, the insertion force when the terminal is accommodated within the housing is reduced (making the insertion force low).

(2) Since the locking member enters the concave portion formed at the lower portion of the terminal, the terminal accommodated in the housing does not slip out toward the terminal insertion slot side any more (slip-out prevention).

(3) Since the locking member does not enter the concave portion formed at the lower portion of the terminal in a state where the terminal is accommodated in a half-insertion state within the housing, the terminal cannot move laterally (half-insertion state prevention).

(4) Since a plurality of types of two-terminal to four-terminal joint connectors can be made simply by the housing having the locking member therein and the U-shaped spring, excessive bus bars become unnecessary, respectively, and only a small number of parts are required (reduction in the number of parts).

(5) Additionally, since an exclusive bus bar to be inserted into terminals is not used, there is no concern about the knocking of the tab portions of the bus bar (knocking prevention).

(6) According to the above invention, since the terminals can be inserted into the housing from the terminal insertion slot at a frontage in a state where the movable lance is retreated, the insertion force when the terminals are accommodated within the housing is reduced (making the insertion force low).

(7) Since the plurality of terminals can be collectively inserted from the wide terminal insertion slot at the frontage, productively is improved (improvement in productivity).

(8) Since the movable lance returns to the inside of the housing after insertion, the terminals accommodated in the housing do not slip out toward the terminal insertion slot.

(9) Since the movable lance cannot be returned in a state where the terminals are half-inserted into the housing, a half-insertion state of the terminals is simply ascertained (half-insertion state prevention).

(10) Since a plurality of types of joint connectors of a plurality of terminals can be made simply by the housing having the movable lance therein and the spring, exclusive bus bars become unnecessary, respectively, and only a small number of parts are required (reduction in the number of parts).

(11) Additionally, since an exclusive bus bar to be inserted into the terminals is not used, there is no concern about knocking of tab portions of the exclusive bus bar (knocking prevention).

BRIEF DESCRIPTION OF THE DRAWINGS

FIG. 10A shows a state where a movable lance has retreated from a bottom of the housing, and FIG. 10B shows a state where the movable lance has returned to the bottom of the housing.

FIG. 11A shows a state where the movable lance has retreated from the bottom of the housing, and FIG. 11B shows a state where the movable lance has returned to the bottom of the housing.

FIGS. 12A to 12E show a sequence from (FIG. 12A) before the insertion of the terminal into the housing to (FIG. 12E) the completion of insertion of the terminal.

18A shows an example of two terminals, FIG. 18B shows an example of three terminals, and FIG. 18C shows an example of five terminals.

DESCRIPTION OF THE PREFERRED EMBODIMENTS

A joint connector related to the invention in which only a small number of parts is required, there is no concern about punching of tab portions of a bus bar, which has a large terminal holding force (slip-out prevention), and in which the insertion force when accommodating terminals within a housing is small, and prevention of half-insertion of the terminals can be simply performed will be described with reference to the drawings.

(Component Part of Joint Connector Related to the Invention)

Figure 1:
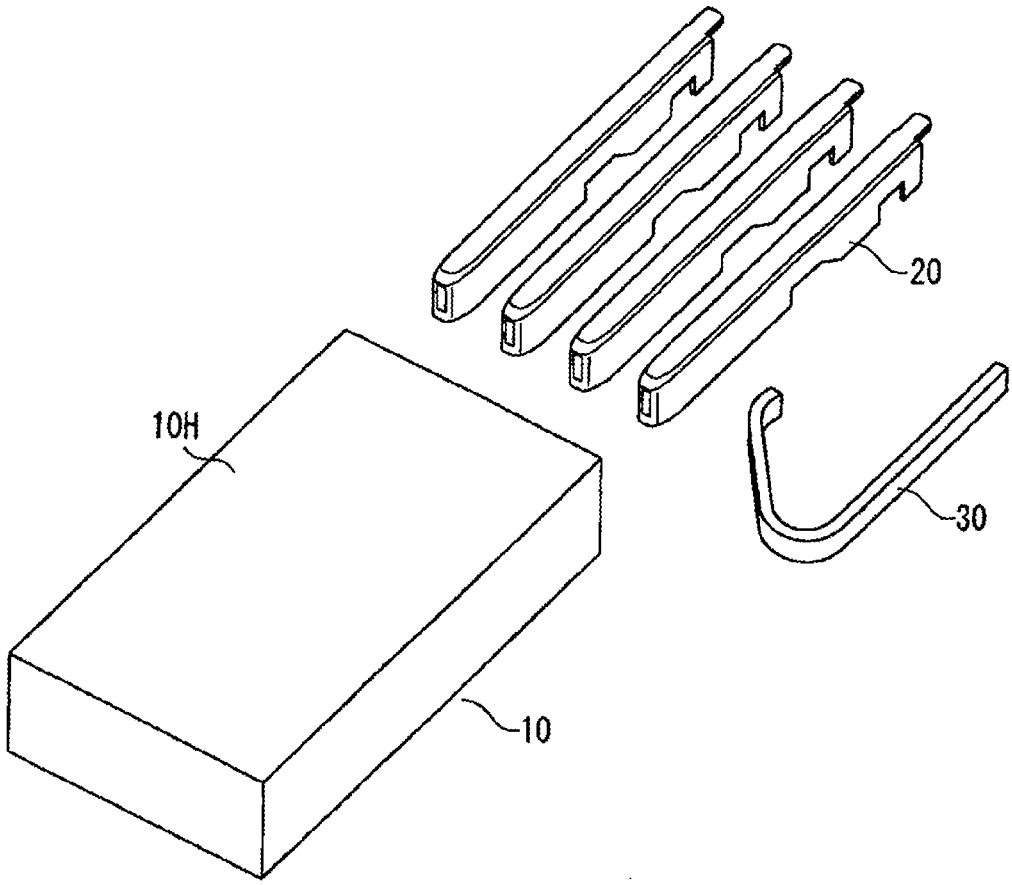
FIG. 1 is an exploded perspective view of a joint connector related to the invention.
Figure 2:
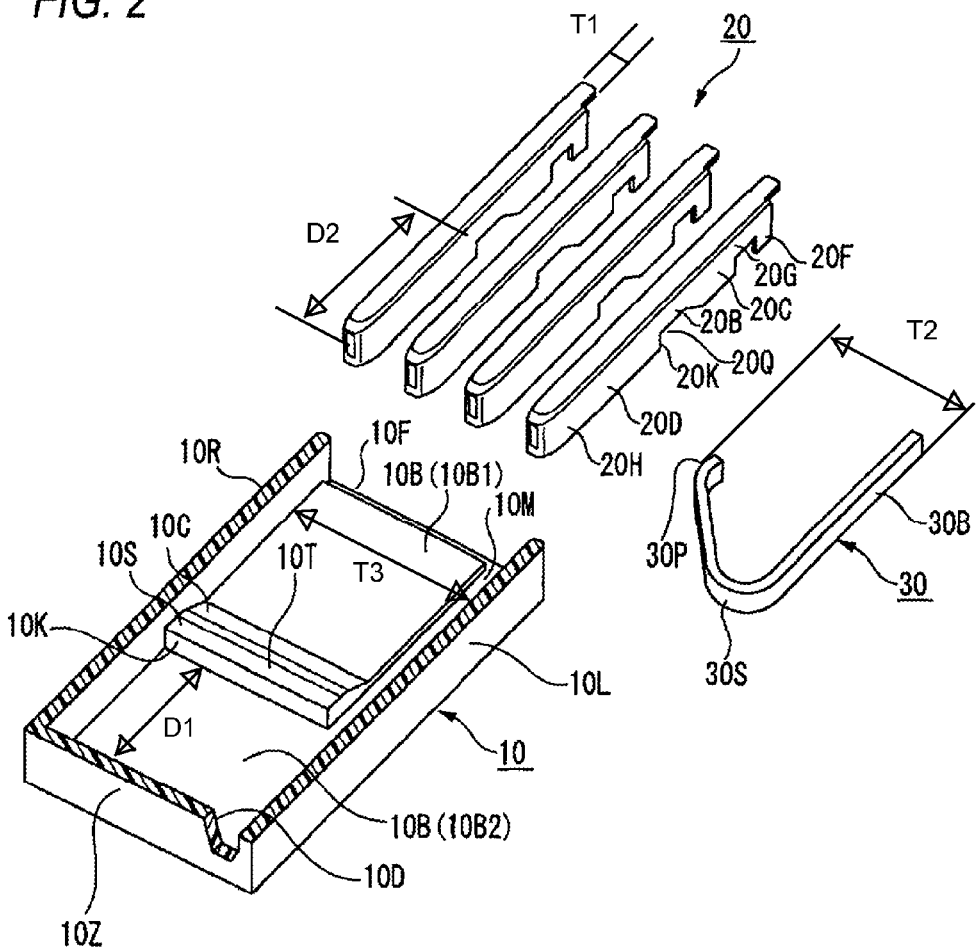
FIG. 2 is an exploded perspective view showing a housing of the joint connector of FIG. 1 that is sectioned at a middle height.

FIG. 1 is an exploded perspective view of a joint connector related to the invention. FIG. 2 is an exploded perspective view showing a housing of the joint connector of FIG. 1 that is sectioned at a middle height. The joint connector related to the invention is composed only of a housing 10, terminals 20, and a spring 30 as shown in FIG. 1, and has the feature of not including the exclusive bus bar as in Patent Document 1.

The housing 10, the terminals 20, and the spring 30 will be described below on the basis of FIGS. 1 and 2.

(Housing 10)

<<Shape of Housing 10>>

The housing 10 is provided to accommodate a required number of terminals therein and to electrically connect all of these terminals, and is a rectangular parallelepiped having therein a large hollow space that can accommodate a plurality of terminals in a contact state in parallel. The housing is formed with a terminal insertion slot that is wide to such an extent that the terminals 20 (FIG. 1) are inserted thereinto by removing a front wall of the housing. The other three side walls (that is, a back wall 10Z, a right wall 10R, and a left wall 10L) are blocked without any gap by connecting the bottom 10B and a ceiling 10H (FIG. 1) together. In addition, although a portion of the back wall 10Z is cut out and shown in FIG. 2, this cut-out is just a cut-out for showing that the inner wall surface 10D of the back wall 10Z is vertical, and is not present in practice.

<<Formation of Locking Member 10T Inside>>

A locking member 10T having a trapezoidal cross-section is formed parallel to the back wall 10Z toward the inner wall surface of the right wall 1 OR from a position separated at a predetermined distance (D1) in the direction of the terminal insertion slot 10F from the inner wall surface 10D of the back wall 10Z and at the position formed with a gap having almost the same width as the breadth (T1) of the terminal 20 from the inner wall surface of the left wall 10L.

The locking member 10T has a shape composed of a locking surface 10K that rises vertically from the bottom 10B on the side that faces the back wall 10Z, a horizontal surface 10S that extends parallel to the ceiling 10H on the side that faces the ceiling 10H (FIG. 1), and an inclined surface 10C that goes down obliquely to the bottom 10B from the end of the horizontal surface 10S. The locking surface 10K engages a locking portion 20K of a concave portion 20Q formed at a lower portion of a coupling portion 20B of the terminal 20 to be described below. That is, the locking member 10T is a long body having a convex cross-section that enters the concave portion 20Q.

<<Formation of Groove 10M Inside>>

The bottom 10B is formed such that a bottom 10B1 on the side of the terminal insertion slot 10F with the locking member 10T as a boundary is slightly higher than a bottom 10B2 of the back wall 10Z, and the groove 10M having the same width as the breadth (T1) of the terminal 20 is formed on the side of the left wall 10L of the bottom 10B1.

(Terminal 20)

The terminal 20 is a female terminal that is manufactured by press-forming a conductive metal plate, is electrically connected with a core of an electric wire at the tip of the electric wire, and is mechanically connected with an insulating outer envelope that surrounds the core. For example, the terminal 20 includes a barrel portion 20D as a long terminal body having a taper at the tip in the insertion direction so as to be easily inserted into the terminal insertion slot 10F of the housing 10, and having a substantially U shape and a substantially square shape as a cross-sectional shape perpendicular to the insertion direction, an electrical connecting portion 20H having a substantially square cross-sectional shape that is formed as a front end (tip portion) of the barrel portion 20D in the insertion direction, a core crimping portion 20C formed at an intermediate portion of the barrel portion 20D, and an outer envelope crimping portion 20F formed near a rear end of the barrel portion 20D in the insertion direction. In addition, in the drawing, illustration of the electric wire is omitted, and the shape of the terminal 20 before being connected with the electric wire is shown.

The electrical connecting portion 20H crimps the core of an electric wire to electrically connect the core of the electric wire and the terminal 20 together. The concave portion 20Q in side view is formed at a lower portion of the coupling portion 20B that couples the electrical connecting portion 20H and the core crimping portions 20C together. In addition, a rear coupling portion 20G that couples the core crimping portion 20C and the outer envelope crimping portion 20F together is also formed therebetween.

The outer envelope crimping portion 20F crimps the insulating outer envelope that surrounds the core of the electric wire, thereby mechanically connecting the electric wire and the terminal 20. The vertical locking portion 20K is formed at the portion of the electrical connecting portion 20H that forms the portion of the concave portion 20Q on the tip side in the insertion direction. The length (D2) from the tip of the barrel portion 20D in the insertion direction to the locking portion 20K at the rear end and the distance (D1) from the inner wall surface 10D of the back wall 10Z to the locking surface 10K of the locking member 10T are almost equal.

$D1 \cong D2$ (of a type in which $D1 > D2$ is satisfied because clearance is required therebetween).

From this relational expression, the concave portion 20Q can engage the engaging member 10T only in a state where the terminal 20 abuts on the inner wall surface 10D of the back wall 10Z of the housing 10 through the groove 10M, and the locking portion 20K is locked by the locking surface 10K of the locking member 10T. Accordingly, the locking portion 20K is not locked to the locking surface 10K in a state where the terminal 20 does not abut on the inner wall surface 10D of the back wall 10Z of the housing 10.

If the locking portion 20K is locked to the locking surface 10K, the terminal 20 cannot be separated from the housing 10. Additionally, if the concave portion 20Q and the locking member 10T engage each other, the terminal 20 can move laterally along the locking member 10T inside the housing 10.

(Spring 30)

The spring 30 is an elastic metal piece formed substantially in the shape of a U, and is composed of a base 30B including a straight portion, a bent portion 30S, and a pressing contact portion 30P at the tip. The breadth T2 from the base 30B to the pressing contact portion 30P satisfies T2>T3−2×T1 when the inner distance between the inner wall surface of the left wall 10L and the inner wall surface of the right wall 10R is T3, and the breadth of the terminal 20 is T1.

Figure 3:
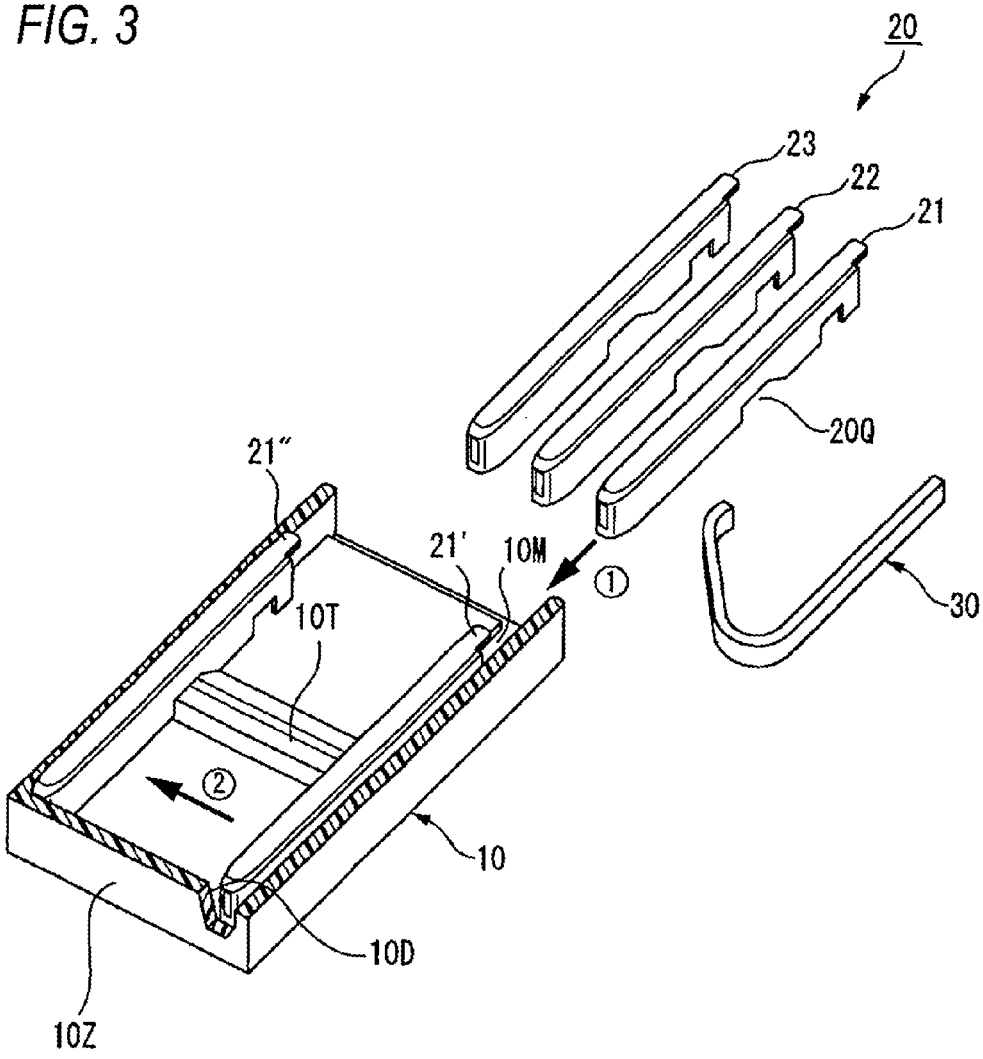
FIG. 3 is a perspective view showing a first step of an assembling procedure of a joint connector related to Embodiment 1 of the invention into which three terminals are assembled.

Method of Assembling Joint Connector Related to Embodiment 1 of the Invention Next, a method of assembling the joint connector related to Embodiment 1 of the invention will be described with reference to FIGS. 3 to 7. Embodiment 1 is a joint connector that accommodates three terminals 21 to 23 in the housing 10 and electrically connects all the three terminals 21 to 23. FIG. 3 is a perspective view showing a first step of an assembling procedure of the joint connector related to Embodiment 1 of the invention.

<<Accommodation of First Terminal>>

In FIG. 3, since the locking member 10T is not formed at the portion of the groove 10M, and the width of the groove 10M is almost equal to the breadth of a terminal 21, the terminal 21 can be inserted into the deep side of the housing 10 through the groove 10M with a low insertion force. Thus, first, if the first terminal 21 bumps against the inner wall surface 10D of the back wall 10Z of the housing 10 through the groove 10M of the housing 10, the first terminal does not advance any more, and the insertion thereof stops here.

Since the trapezoidal cross-section of the locking member 10T can enter the concave portion 20Q formed at the lower portion of the terminal 20 in side view and has a relationship in which the length (D2) from the tip of the barrel portion 20D in the insertion direction to the locking surface 20K at the rear end, and the distance (D1) from the back wall 10Z to the locking surface 10K of the locking member 10T are almost equal (D1≅D2) (here, a sort of D1>D2), the terminal 20 accommodated in the deep side of the housing 10 can move laterally along the locking member 10T. Thus, a terminal 21' abutting on the inner wall surface 10D and accommodated is laterally moved along the locking member 10T, abuts on the right wall 10R and stops here as a terminal 21".

(Effect 1 of The Invention)

(1) As such, according to the invention, the terminal 21' is merely passed through the groove 10M having almost the same width as the breadth, and a related-art configuration in which an engaging portion rides over a fitting slope is not adopted. Therefore, the insertion force when accommodating the terminal within the housing is reduced (making insertion force low).

(2) Since the locking member 10T enters the concave portion 20Q formed at the lower portion of the terminal 21", the terminal 21" once accommodated in the housing does not slip out toward the terminal insertion slot 10F (FIG. 2) side any more (slip-out prevention).

(3) Since the locking member 10T becomes a hindrance the terminal cannot move laterally in a state where the terminal 21 is half-inserted into the housing 10, and the half-insertion state of the terminal 21 is simply ascertained.

<<Accommodation of Second Terminal>>

Figure 4:
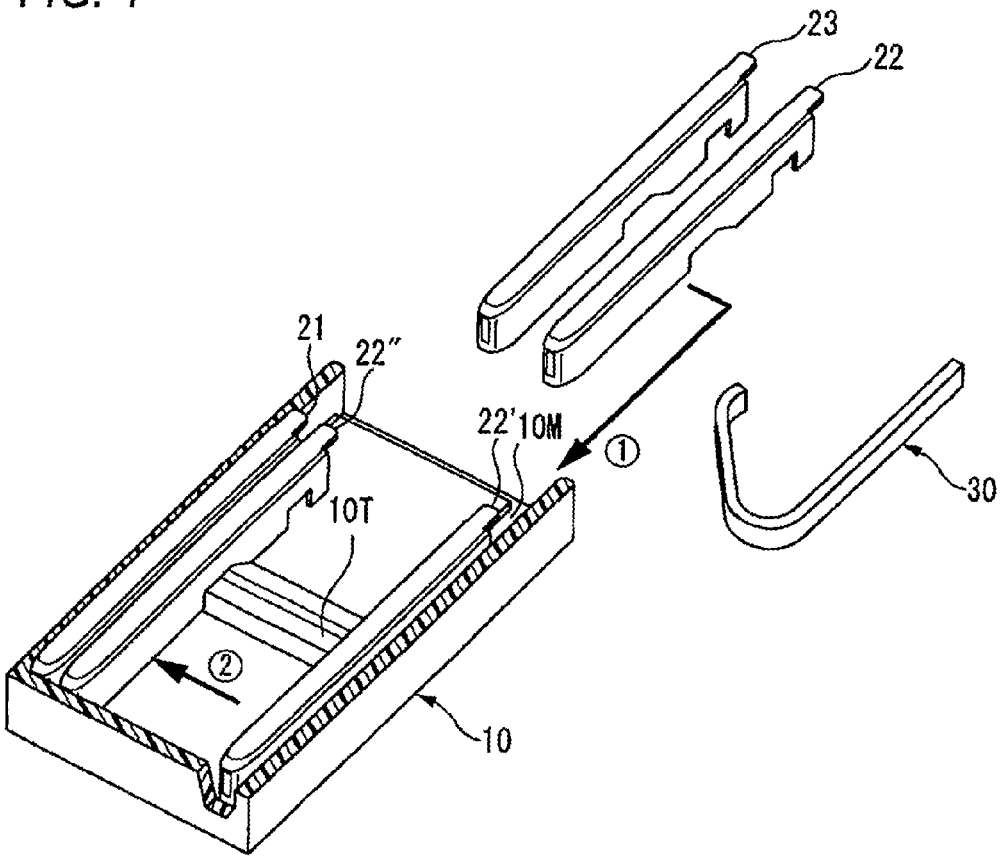
FIG. 4 is a perspective view showing a second step following the first step of FIG. 3.

Next, in FIG. 4, a second terminal 22 bumps against the inner wall surface 10D of the back wall 10Z of the housing 10 through the groove 10M of the housing 10. Thereafter, the terminal 22' is laterally moved along the locking member 10T, abuts on the lateral face of the already inserted terminal 21 and stops here as the terminal 22".

<<Accommodation of Third Terminal>>

Figure 5:
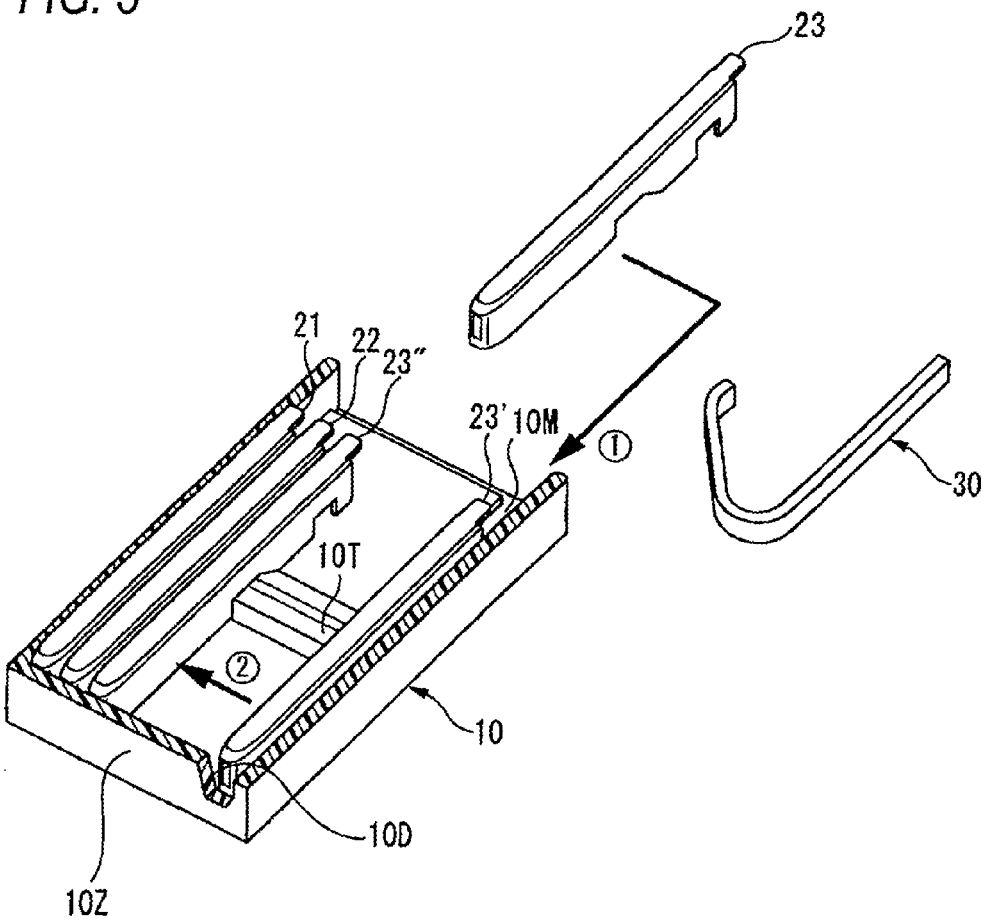
FIG. 5 is a perspective view showing a third step following the second step of FIG. 4.

Similarly, in FIG. 5, a third terminal 23 bumps against the inner wall surface 10D of the back wall 10Z of the housing 10 through the groove 10M of the housing 10. Thereafter, the terminal 23' is laterally moved along the locking member 10T, stops as the lateral face thereof abuts on the already inserted terminal 22, and becomes the terminal 23".

<<Accommodation of Spring>>

Figure 6:
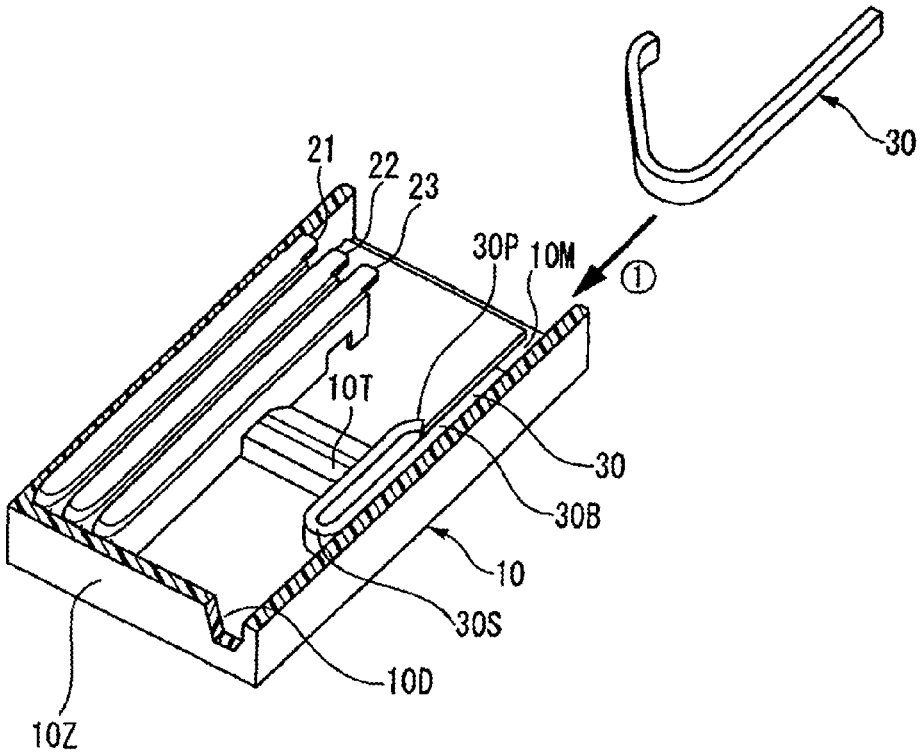
FIG. 6 is a perspective view showing a fourth step following the third step of FIG. 5.
Figure 7:
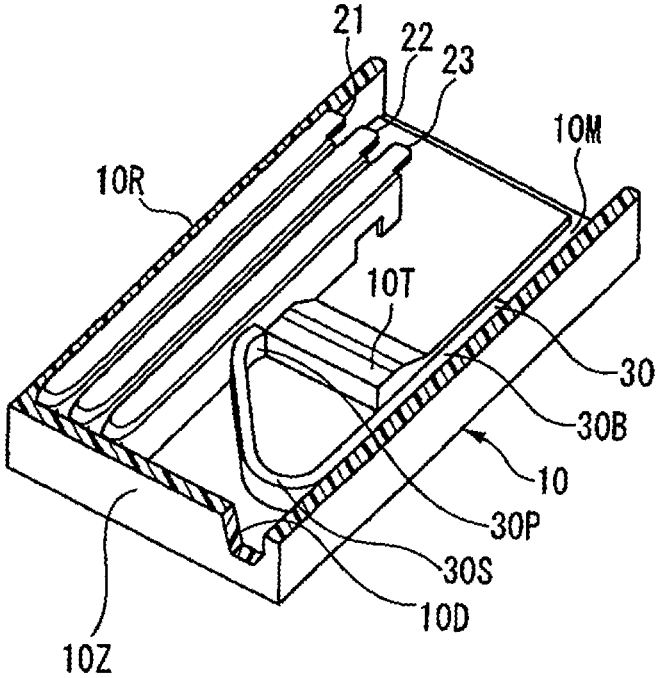
FIG. 7 is a perspective view showing a fifth step following the fourth step of FIG. 6.

Finally, the spring 30 is accommodated as shown in FIG. 6. In FIG. 6, if the spring is passed through the groove 10M (FIG. 2) of the housing 10 in a state where the pressing contact portion 30P at the tip of the spring 30 is pressed against the base 30B side, the pressing contact portion 30P at the tip of the spring 30 is inserted into the deep side in a state where the pressing contact portion is accommodated in the groove 10M. Since the groove 10M disappears if the pressing contact portion 30P at the tip of the spring 30 passes by the locking member 10T, the pressing contact portion 30P at the tip of the spring 30 is enlarged from the base 30B, moves laterally within the housing 10 as shown in FIG. 7, abuts on the barrel portion 20D of the terminal 23, and stops. In this state, since the terminal 23 is pressed in the direction of the right wall 10R by the spring 30, the terminal 23 presses the terminal 22 and the terminal 21 in the direction of the right wall 10R. Eventually, the terminals 21, 22, and 23 are maintained in a mutual contact state, and are brought into an electrical contact state.

<<Completion of Joint Connector>>

Figure 18:
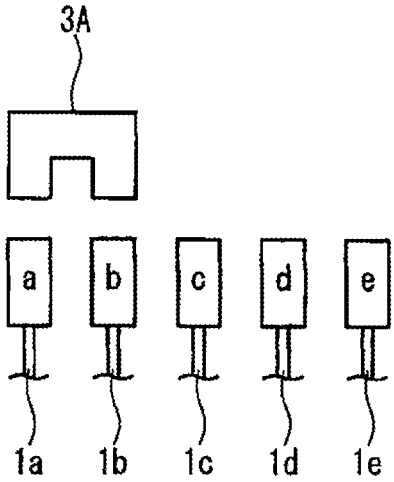
FIGS. 18A to 18C are conceptual diagrams of joint connectors in which each exclusive bus bar is inserted into a plurality of terminals to perform electrical connection; FIG.
Figure 18:
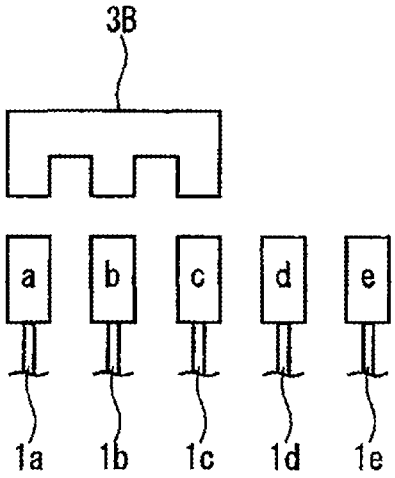
Figure 18:
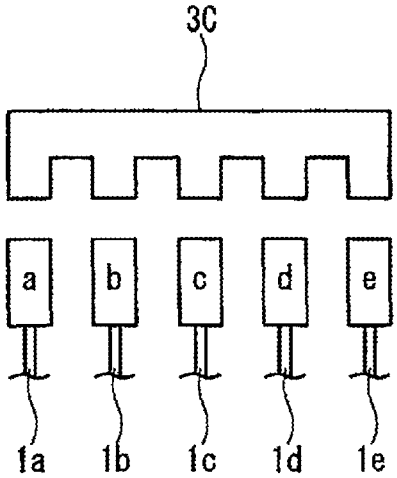
Figure 19:
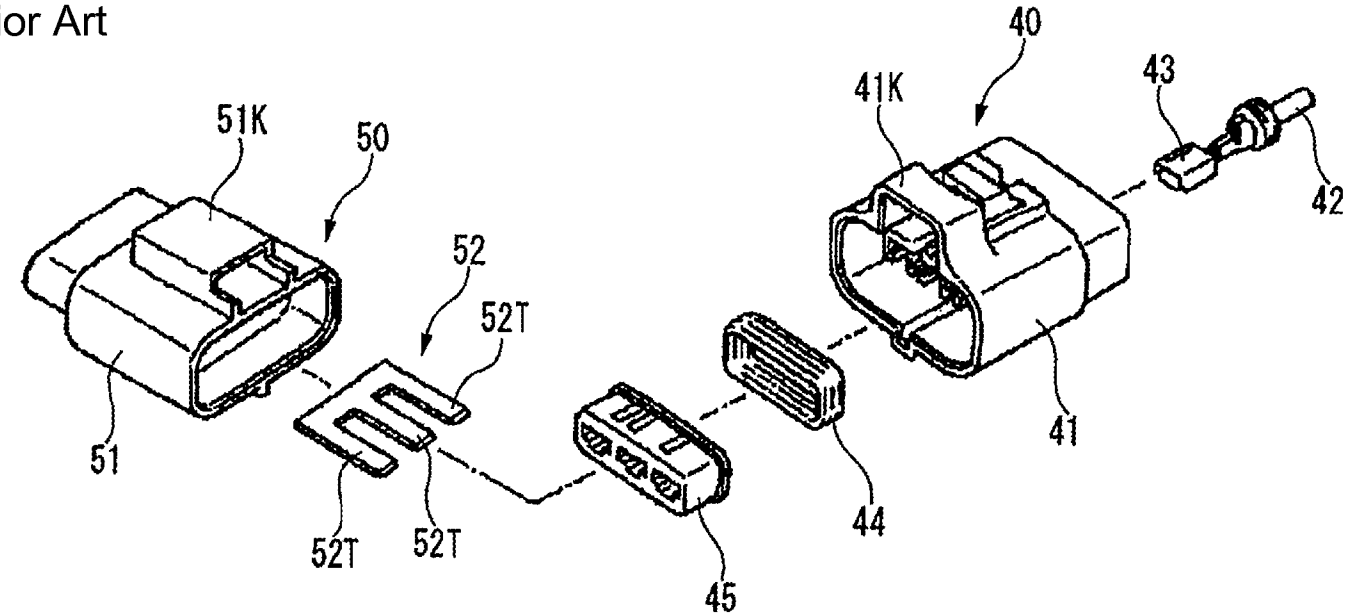
FIG. 19 Prior Art
FIG. 19 is an exploded perspective view of the joint connector disclosed in Patent Document 1 using an exclusive bus bar that commonly connects three terminals shown in FIG. 18B.

As such, according to the invention, even if the exclusive bus bar 3B (FIG. 18B) for three-terminal connection as in Patent Document 1 is not included, the joint connector that electrically connects the three terminals 21, 22, and 23 can be made simply by the housing 10 having the locking member 10T therein and the U-shaped spring 30.

(Effect 2 of the Invention)

(4) As such, according to the invention, since the three-terminal joint connector can be made simply by the housing 10 having the locking member 10T therein and the U-shaped spring 30, only a small number of parts are required.

(5) Additionally, since the exclusive bus bar 3B (FIG. 18B) for three-terminal connection as in Patent Document 1 is not used, there is no concern about the knocking of the tab portions of the bus bar.

Embodiment 2: Two-Terminal Joint Connector

In Embodiment 2 of the invention, a joint connector that electrically connects two terminals can be made even if the exclusive bus bar 3A (FIG. 18A) for two-terminal connection of Patent Document 1 is not included.

Figure 8:
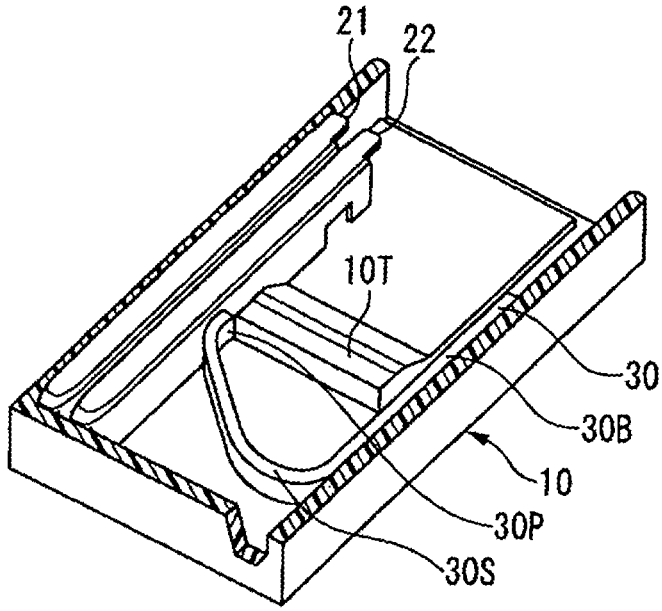
FIG. 8A is a cross-sectional perspective view of a joint connector related to Embodiment 2 of the invention into which two terminals are assembled.
FIG. 8B is a cross-sectional perspective view of a joint connector related to Embodiment 3 of the invention into which four terminals are assembled.
Figure 8:
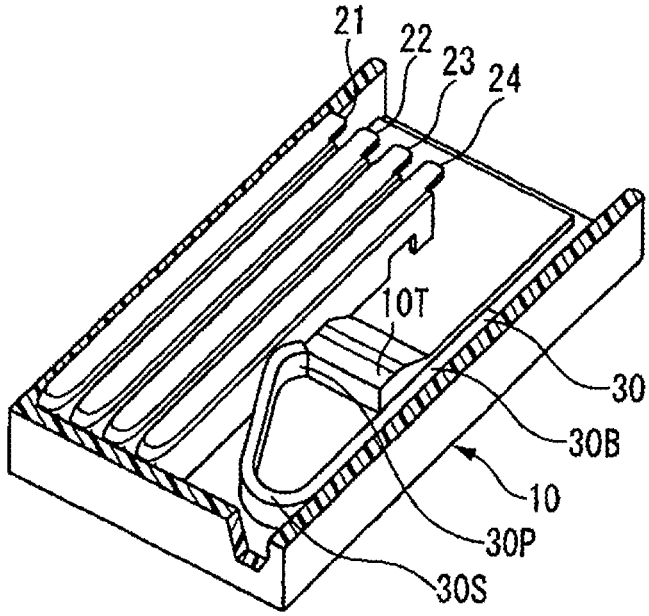

FIG. 8A shows an embodiment of a joint connector that electrically connects two terminals.

First, if the first terminal 21 is accommodated within the housing 10 in the manner described in FIG. 3, the second terminal 22 is then accommodated within the housing 10 in the manner described in FIG. 4, and the spring 30 is accommodated within the housing 10 in the manner described in FIG. 6, a two-terminal accommodating joint connector of FIG. 8A is obtained.

Embodiment 3: Four-Terminal Joint Connector

In Embodiment 3 of the invention, a joint connector that electrically connects four terminals can be made similarly. FIG. 8B shows an embodiment of a joint connector that electrically connects four terminals.

If the first terminal 21 is first accommodated within the housing 10 in the manner described in FIG. 3, the second terminal 22 is then accommodated within the housing 10 in the manner described in FIG. 4, the third terminal 23 is then accommodated within the housing 10 in the manner described in FIG. 5, the fourth terminal 24 is further accommodated within the housing 10 in the manner described in FIG. 5, and the spring 30 is finally accommodated within the housing 10 in the manner described in FIG. 6, a four-terminal accommodating joint connector of FIG. 8B is obtained.

<Conclusion>

(1) As such, according to the invention, since a terminal is merely passed through a groove having the same width as the breadth, the insertion force when the terminal is accommodated within the housing is reduced (making the insertion force low).

(2) Since the locking member enters the concave portion formed at the lower portion of the terminal, the terminal accommodated in the housing does not slip out toward the terminal insertion slot side any more (slip-out prevention).

(3) Since the locking member does not enter the concave portion formed at the lower portion of the terminal in a state where the terminal is accommodated in a half-insertion state within the housing, the terminal cannot move laterally (half-insertion state prevention).

(4) Since a plurality of types of two-terminal to four-terminal joint connectors can be made simply by the housing having the locking member therein and the U-shaped spring, excessive bus bars become unnecessary, respectively, and only a small number of parts are required (reduction in the number of parts).

(5) Additionally, since an exclusive bus bar to be inserted into terminals is not used, there is no concern about the knocking of the tab portions of the bus bar (knocking prevention).

(Component Part of Joint Connector Related to the Invention)

Figure 9:
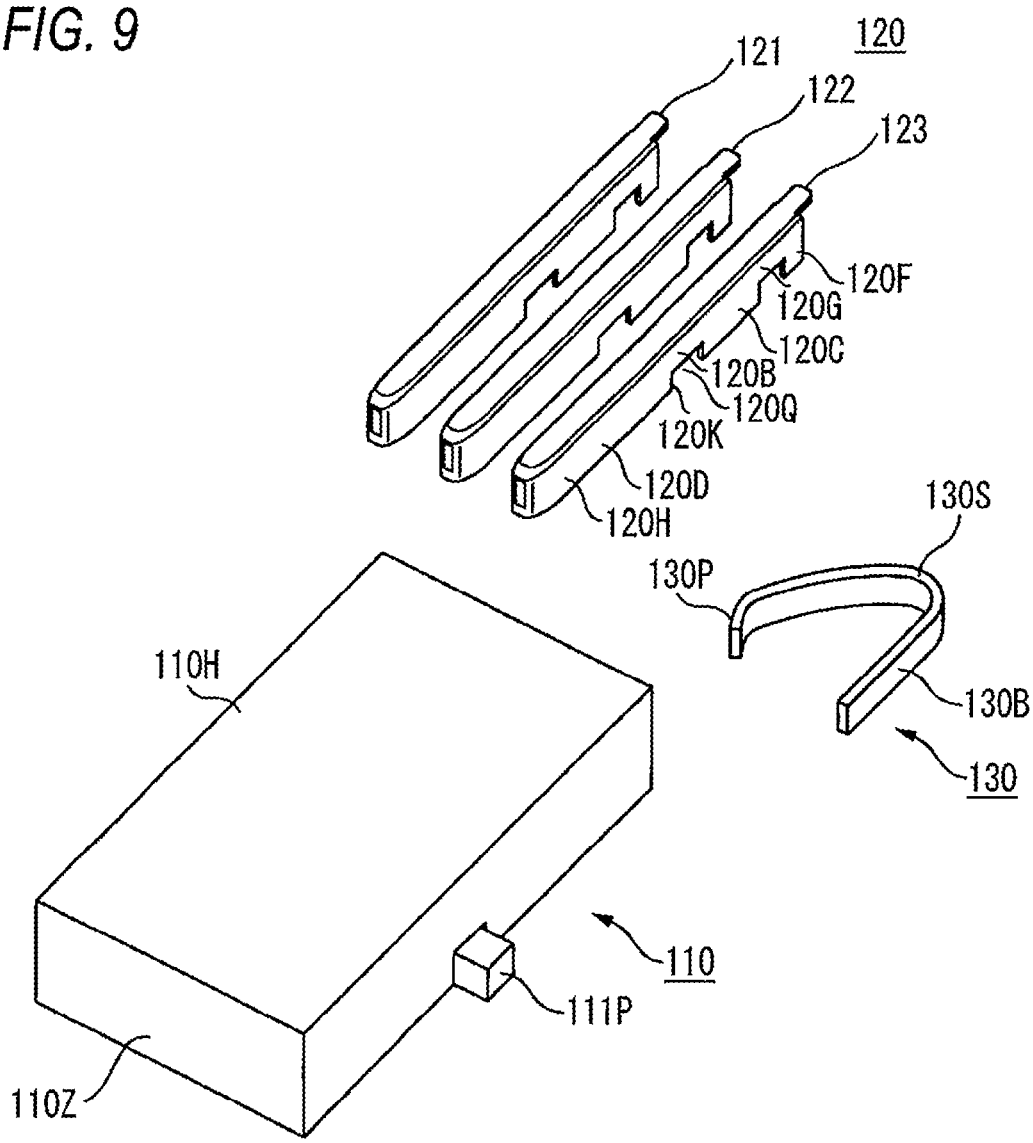
FIG. 9 is an exploded perspective view of a joint connector related to the invention.

FIG. 9 is a perspective view of a joint connector related to the invention. FIGS. 10A and 10B are perspective views showing a housing of the joint connector of FIG. 9 that is sectioned at a middle height; FIG. 10A shows a state where a lance has retreated from a bottom of the housing, and FIG. 10B shows a state where the lance has returned to the bottom of the housing.

The joint connector related to the invention is composed only of a housing 110, terminals 120, and a spring 130 as shown in FIG. 9, and has the feature of not including the exclusive bus bar as in Patent Document 1.

The housing 110, the terminals 120, and the spring 130 will be described below on the basis of FIGS. 9 and 10.

(Housing 110)

The housing 110 (FIG. 9) is provided to accommodate a required number of terminals therein and to electrically connect all of these terminals, and is a rectangular parallelepiped having therein a large hollow space (refer to a bottom 110B of FIG. 10) that can accommodate a plurality of terminals in a contact state in parallel. The housing is formed with a terminal insertion slot 110F (FIG. 10) that is a frontage that is wide to such an extent that a plurality of terminals 120 (FIG. 9) can be collectively inserted thereinto in parallel by removing a front wall of the housing. The other three side walls (that is, a back wall 110Z, a right wall 110R, and a left wall 110L) of the housing 110 (FIG. 10) are blocked without any gap by connecting the bottom 110B and a ceiling 110H (FIG. 9) together. A concave portion 110P (FIG. 11) for accommodating an end 111P of a movable lance 111 is formed below the right wall 110R (FIG. 10) and the left wall 110L (FIG. 10) that are both walls of the housing 110, and the bottom 110B is formed with a large opening 110Q (FIG. 11) for accommodating a movable portion 111M including the following movable lance 111.

(Movable Lance)

FIGS. 11A and 11B are perspective views showing the housing 110 including the movable portion 111M with the bottom 110B thereof turned up; FIG. 11A shows a state where the movable lance 111 has retreated from the bottom 110B of the housing 110, and FIG. 11B shows a state where the movable lance 111 has returned to the bottom 110B of the housing 110.

(Shape of Movable Lance 111)

The vicinities of both end wall surfaces of the bottom 110B of the housing 110 are cut parallel to the wall surfaces, and tips of the cut two sides are further cut so as to be connected together with a straight line, whereby cuts of U-shaped three sides are made in the bottom 110B, and when the three cut sides are used as free ends to push the tips of the free ends, the three cut sides deflect due to the elastic force of a resin material. Thereby, the movable portion 111M is formed.

The movable lance 111 is formed such that the tip of a free end of the movable portion 111M is made longer than the breadth of the bottom 110B and made larger than the thickness of the bottom 110B so as to protrude into an internal space of the housing 110 by the larger thickness. In this way, the movable lance 111 is formed as a long body with a rectangular cross-section that is longer than the breadth of the bottom 110B and larger than the thickness of the bottom 110B.

<<Position of Movable Lance 111>>

As for the installation position of the movable lance 111, the movable lance is formed at a position apart by a predetermined distance (D1) from the back wall 110Z of the bottom 110B in the direction of the terminal insertion slot 110F, and both ends 111P of the movable lance 111 protrude from both the walls (110R, 110L) of the housing 110.

<<Retreat and Return of Movable Lance 111>>

By operating to push down the ends 111P in the direction of F (FIG. 11A) from the outside with an operating mechanism (not shown), the movable portion 111M deflects, and the movable lance 111 formed at the tip thereof retreats to the outside from the bottom 110B of the housing 110.

On the contrary, by operating the ends in a direction (FIG. 11A) opposite to the direction F from the outside, the movable lance 111 returns to the bottom 110B of the housing 110 as shown in FIG. 11B.

<<Cross-Sectional Shape of Movable Lance 111>>

Figure 10:
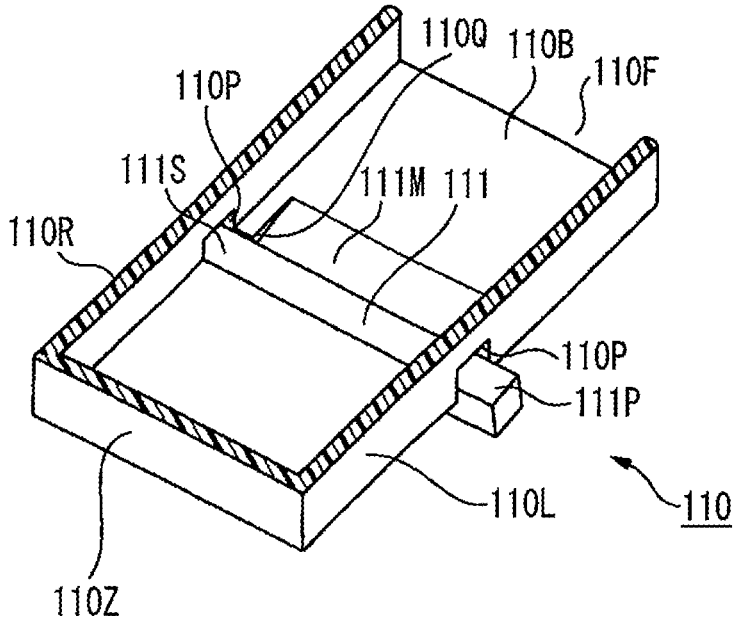
FIGS. 10A and 10B are perspective views showing a housing of the joint connector of FIG. 9 that is sectioned at a middle height.
Figure 10:
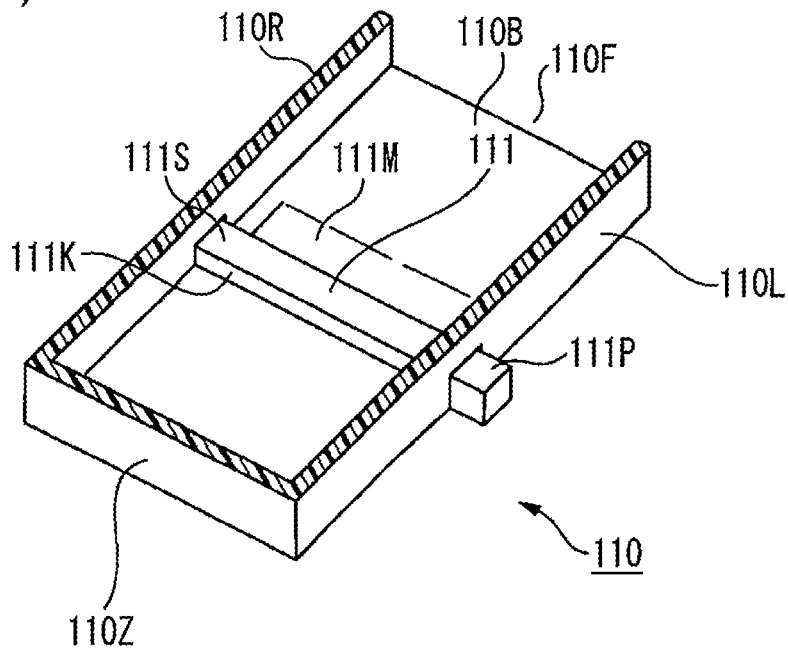
Figure 11:
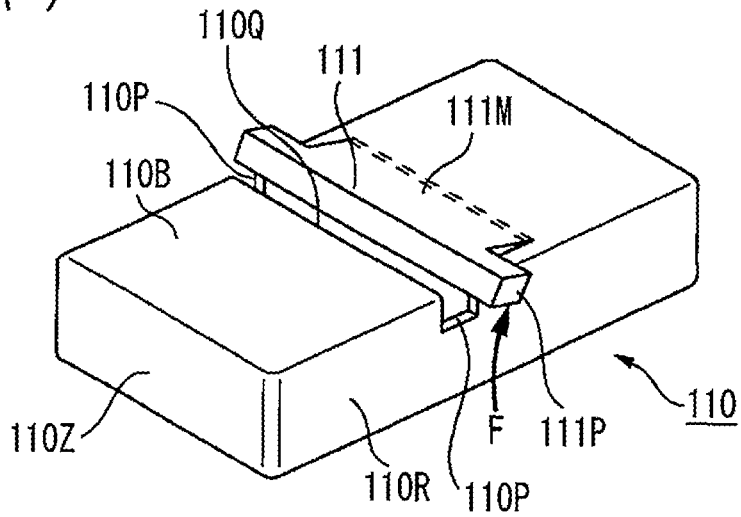
FIGS. 11A and 11B are perspective views showing the housing forming the movable lance with the bottom thereof turned up.
Figure 11:
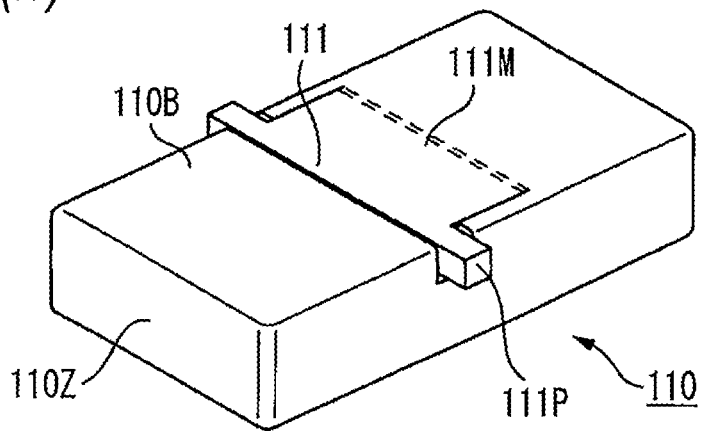

Referring to FIG. 10, the rectangular cross-sectional shape of the movable lance 111 has a rectangular shape composed of a locking surface 111K (FIG. 10B, FIG. 12A) that rises vertically from the bottom 110B on the side that faces the back wall 110Z, a horizontal surface 111S (FIGS. 10A and 10B, FIG. 12A) that extends parallel to the ceiling 110H on the side that faces the ceiling 110H (FIG. 9), and a vertical surface 111C (FIG. 12A) that goes down vertically to the bottom 110B from the end of the horizontal surface 111S. The locking surface 111K engages a locking portion 120K of a concave portion 120Q (FIG. 9, FIG. 12A) formed at a lower portion of a core crimping portion 120C (FIG. 9) of the terminal 120 (FIG. 9) at the time of the return of the movable lance 111.

(Terminal 120)

The terminal 120 is a female terminal that is manufactured by press-forming a conductive metal plate, is electrically connected with a core of an electric wire at the tip of the electric wire, and is mechanically connected with an insulating outer envelope that surrounds the core. For example, the terminal 120 includes a barrel portion 120D as a long terminal body having a taper at the tip in the insertion direction so as to be easily inserted into the terminal insertion slot 110F of the housing 110, and having a substantially U shape and a substantially square shape as a cross-sectional shape perpendicular to the insertion direction, an electrical connecting portion 120H having a substantially square cross-sectional shape that is formed as a front end (tip portion) of the barrel portion 120D in the insertion direction, the core crimping portion 120C formed at an intermediate portion of the barrel portion 120D, and an outer envelope crimping portion 120F formed near a rear end of the barrel portion 120D in the insertion direction. In addition, in the drawing, illustration of the electric wire is omitted, and the shape of the terminal 120 before being connected with the electric wire is shown.

The core crimping portion 120C crimps the core of the electric wire, thereby electrically connecting the core of the electric wire and the terminal 120. The concave portion 120Q in side view is formed at a lower portion of a coupling portion 120B that couples the electrical connecting portion 120H and the core crimping portions 120C together. In addition, a rear coupling portion 120G that couples the core crimping portion 120C and the outer envelope crimping portion 120F together is also formed therebetween.

Figure 12:
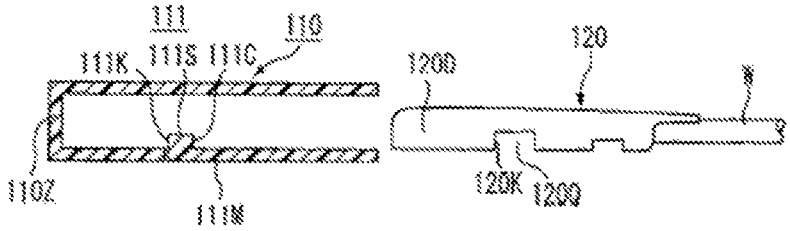
FIGS. 12A to 12E are longitudinal sectional views illustrating the relative operation between the movable lance and a terminal that are sectioned in an insertion direction through the center of the movable lance in the width direction.
Figure 12:
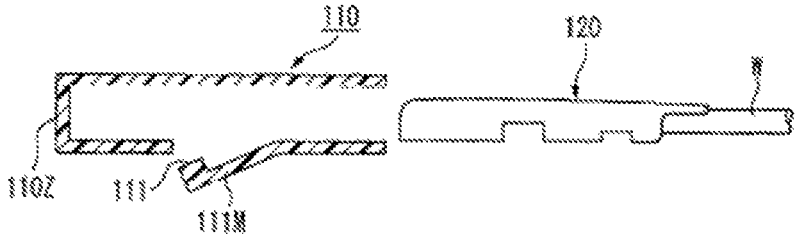
Figure 12:
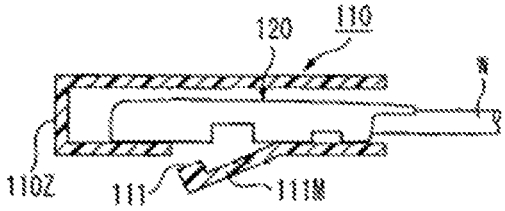
Figure 12:
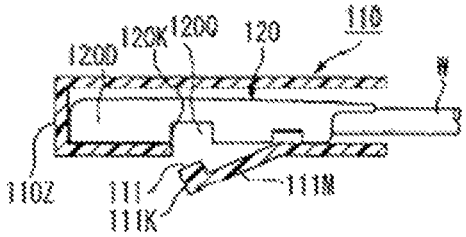
Figure 12:
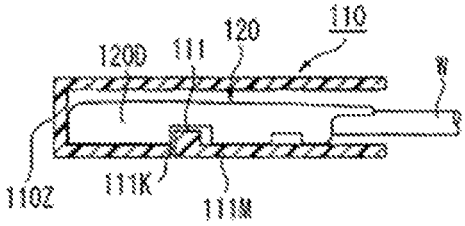

The outer envelope crimping portion 120F crimps the insulating outer envelope that surrounds the core of the electric wire, thereby mechanically connecting the electric wire and the terminal 120. The vertical locking portion 120K is formed at the portion of the electrical connecting portion 120H that forms the portion of the concave portion 120Q on the tip side in the insertion direction. The locking portion 120K can be locked to the locking surface 111K (to be described below) (FIG. 12D) of the movable lance 111, and if the locking portion is locked, the terminal 120 cannot be separated from the housing 110 (to be described below) (FIG. 12E).

<<Dimensional Relationship between Terminal 120 and Movable Lance 111>>

The length (D2) from the tip of the barrel portion 120D of the terminal 120 in the insertion direction to the locking portion 120K at the rear end and the distance (D1) from the back wall 110Z to the locking surface 111K of the movable lance 111 are almost equal.

D1≅D2 (of a type in which D1>D2 is satisfied because clearance is required therebetween).

From this relational expression, the movable lance 111 can enter the concave portion 120Q of the terminal 120 only in a state where the terminal 120 abuts on an inner wall surface 110D of the back wall 110Z of the housing 110. If the movable lance 111 enters the concave portion 120Q of the terminal 120, the terminal 120 can no longer separate from the housing 110.

Since the movable lance 111 cannot enter the concave portion 120Q of the terminal 120 in a state (half-insertion) where the terminal 120 does not bump against the back wall 110Z, the half-insertion can be simply ascertained.

(Spring 130)

The spring 130 (FIG. 9) is an elastic metal piece formed substantially in the shape of a U, and is composed of a base 130B including a straight portion, a bent portion 130S, and a pressing contact portion 130P at the tip. The breadth T2 from the base 130B to the pressing contact portion 130P satisfies T2>T3−2×T1 when the inner distance between the left wall 110L and the right wall 110R is T3, and the breadth of the terminal 120 is T1.

(Relative Operation between Movable Lance 111 and Terminal 120)

FIGS. 12A to 12E are longitudinal sectional views illustrating the relative operation between the movable lance 111 and the terminal 120 that are sectioned in the insertion direction through the center of the movable lance 111 in the width direction, and FIGS. 12A to 12E show a sequence from (FIG. 12A) before the insertion of the terminal 120 into the housing 110 to (FIG. 12E) the completion of insertion of the terminal 120.

FIG. 12A shows that the movable lance 111 at the bottom of the housing 110 is accommodated in the housing 110 in a state before the terminal 120 is inserted into the housing 110. In this state, the locking surface 111K at the tip of the movable lance 111 is in a vertical state.

FIG. 12B shows that the movable lance 111 retreats from the bottom of the housing 110 by the turning of the movable portion 111M to the side opposite to the housing, in a state just before the terminal 120 is inserted into the housing 110. Since the movable lance 111 retreats from the bottom of the housing 110 in this state, the terminal 120 can be inserted into the inside of the housing 110.

FIG. 12C shows a state where the terminal 120 is inserted into the housing 110, passes above the movable lance 111, and abuts on the back wall 110Z. Since the movable lance 111 retreats from the bottom of the housing 110, the terminal 120 is inserted into the housing 110 with a low insertion force. When this state is seen from the outside, the terminal 120 is seen so as to be completely inserted into the housing 110. If an attempt to return the movable lance 111 is made in this state, since the movable lance 111 collides against the barrel portion 120D of the terminal 120 and cannot return to the housing 110, half-insertion of the terminal 120 into the housing 110 can be simply ascertained.

FIG. 12D shows that the terminal 120 is inserted into the deep side of the housing 110, and abuts on the back wall 110Z. In this state, the concave portion 120Q of the terminal 120 is at a position where the movable lance 111 can be returned.

FIG. 12E shows that the movable lance 111 returns to the housing 110 by the turning of the movable portion 111M toward the housing side since the concave portion 120Q of the terminal 120 is located at a position where the movable lance 111 can be returned. According to the invention, since the movable lance 111 enters the concave portion 120Q of the terminal 120 in this state, the locking portion 120K of the terminal 120 engages the locking surface 111K of the movable lance 111 to prevent separation of the terminal 120 from the housing 110.

Method of Assembling Joint Connector Related to Embodiment 4 of the Invention Next, a method of assembling the joint connector related to Embodiment 4 of the invention will be described with reference to FIGS. 13 to 16. Embodiment 4 is a joint connector that accommodates three terminals 121 to 123 in the housing 110 and electrically connects all the three terminals 121 to 123.

<<First Step: Retreat of Movable Lance>>

Figure 13:
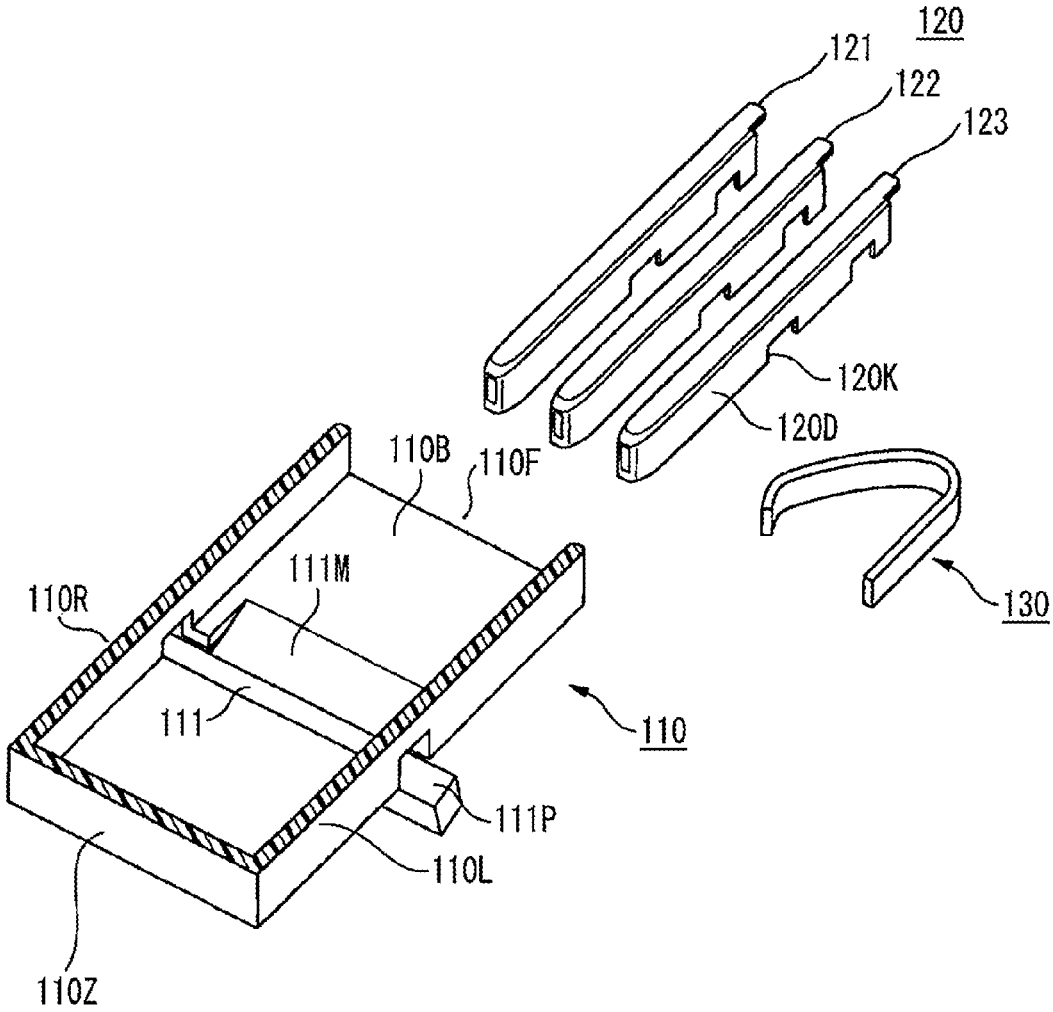
FIG. 13 is a perspective view showing a first step of an assembling procedure of a joint connector related to Embodiment 4 of the invention into which three terminals are assembled.

FIG. 13 is a perspective view showing a first step of an assembling procedure of the joint connector related to Embodiment 4 of the invention. In FIG. 13, as an external operating mechanism (not shown) performs the operation of pushing down the end 111P of the movable lance 111 in the housing 110 in the state of FIG. 10B, the movable portion 111M turns toward the side opposite to the housing, and the movable lance 111 formed at the tip retreats from the bottom of the housing 110 (is brought into the state of FIG. 12B from FIG. 12A). Accordingly, the terminal 120 can be inserted into the internal space of the housing 110 without any hindrance in this state.

<<Second Step: Insertion of Terminal>>

Figure 14:
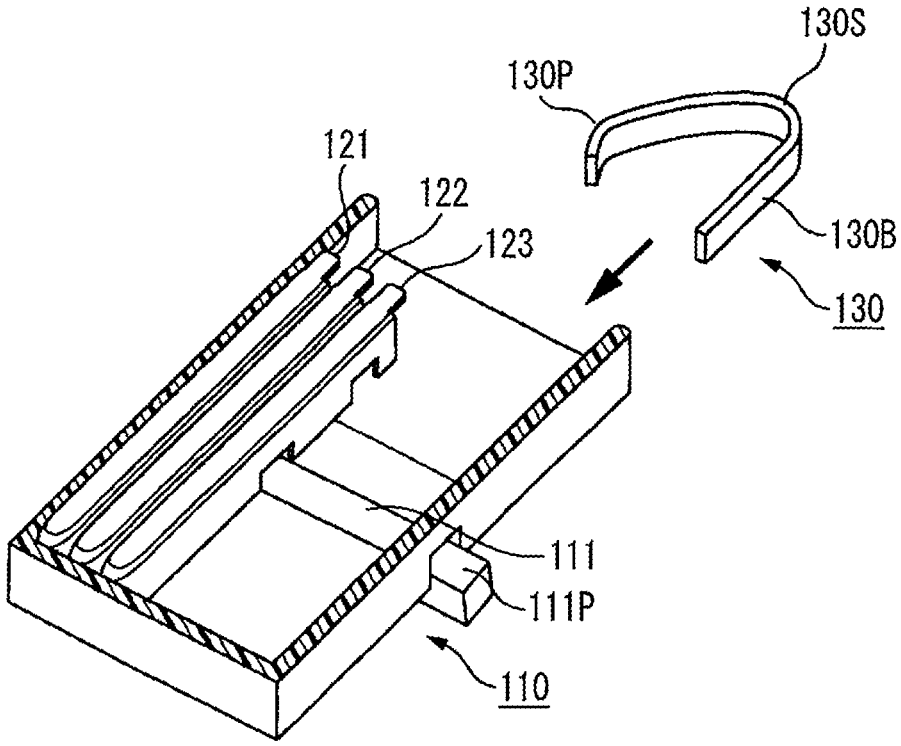
FIG. 14 is a perspective view showing a second step following the first step of FIG. 13.

In FIG. 14, three terminals 121, 122, and 123 are sequentially inserted into the internal space of the housing 110 without any hindrance, and are accommodated in parallel to each other (in the state of FIG. 12D through FIG. 12C). According to invention, since the movable lance 111 retreats from the bottom of the housing 110, all the terminals 121, 122, and 123 are inserted into the housing 110 with a low insertion force. Although the three terminals 121, 122, and 123 are arranged in parallel, the terminals are in an electrically imperfect contact state.

Since the movable lance 111 remains having retreated from the bottom of the housing 110, the spring 130 can next be inserted.

<<Third Step: Insertion of Spring>>

Figure 15:
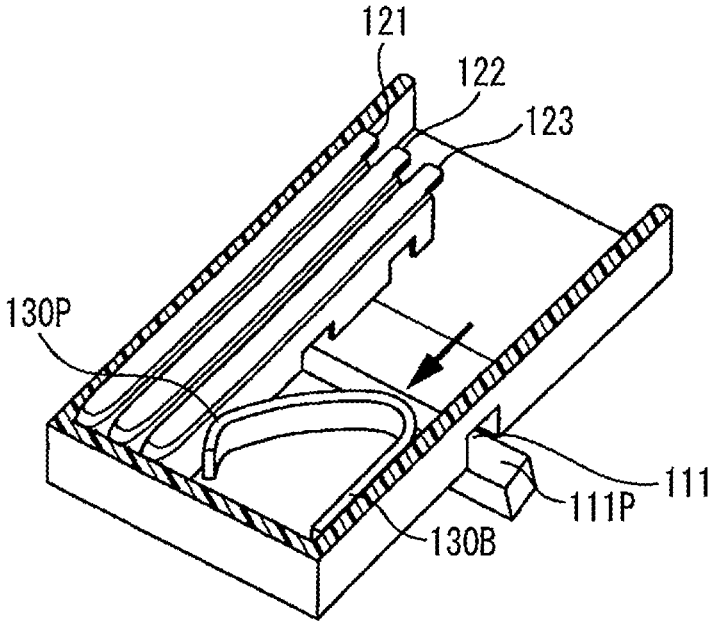
FIG. 15 is a perspective view showing a third step following the second step of FIG. 14.

In FIG. 14, if the pressing contact portion 130P at the tip of the spring 130 is inserted into the internal space of the housing 110 and pushed into the deep side, in a state the pressing contacting portion is pressed against the base 130B side, since the relationship of T2>T3−2×T1 is satisfied among the breadth T2 from the base 130B to the pressing contact portion 130P, the inner distance T3 between the left wall 110L and the right wall 110R, and the breadth T1 of the terminal 120, as shown in FIG. 15, the pressing contact portion 130P at the tip of the spring 130 is enlarged from the base 130B and presses the barrel portion 120D of the terminal 123 in the direction of the right wall 110R. Thus, the terminals 121, 122, and 123 come into contact with each other strongly mechanically, and all the terminals are brought into an electrically connection state.

<<Fourth Step: Return of Movable Lance>>

Figure 16:
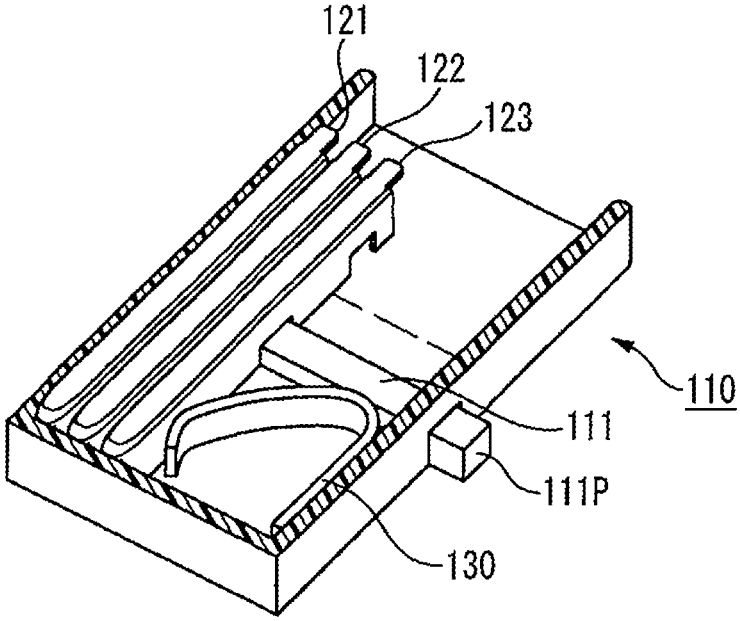
FIG. 16 is a perspective view showing a fourth step following the third step of FIG. 15.

In FIG. 16, as an external operating mechanism performs the operation of pushing up the end 111P of the movable lance 111, the movable portion 111M turns toward the housing side, and the movable lance 111 formed at the tip returns to the bottom of the housing 110, and enters the concave portion 120Q of the terminals 121 to 123 in a full insertion state (state of FIG. 12E). Once the movable lance 111 enters the concave portion 120Q of the terminal 120, the locking portion 120K of the terminal 120 engages the locking surface 111K of the movable lance 111 to prevent the terminal 120 from separating from the housing 110.

Additionally, if at least one of the terminals 121 to 123 is in an imperfect insertion state, since the movable lance 111 collides against the barrel portion 120D of the terminal and cannot return to the inside of the housing 110 even if an attempt to return the movable lance 111 is made, half-insertion of the terminals is simply ascertained.

<<Completion of Joint Connector>>

As such, according to the invention, even if the exclusive bus bar 103B (FIG. 18B) for three-terminal connection as in Patent Document 1 is not included, the joint connector that electrically connects the three terminals 121, 122, and 123 can be made simply by the housing 110 having the movable lance 111 therein and the U-shaped spring 130.

(Effects of the Invention)

(1) As such, according to the invention, since the terminals 121 to 123 are inserted into a wide internal space with no hindrance inside the housing, the insertion force when the terminals are accommodated within the housing is reduced (making the insertion force low).

(2) As for the terminals 121 to 123 accommodated in the housing 110, since the movable lance 111 enters the recesses 120Q formed at the lower portions of the terminals 121 to 123, the terminals 121 to 123 once accommodated in the housing no longer slip out toward the terminal insertion slot 110F (FIG. 10) side (slip-out prevention). Accordingly, a terminal holding force is improved (slip-out prevention).

(3) Since the barrel portions 120D of the terminals hinder the returning operation of the movable lance 111 in a state where at least one of the terminals 121 to 123 is in an imperfect insertion state inside the housing 110, the movable lance 111 cannot return and thereby, imperfect insertion of the terminal 121 is simply ascertained.

(4) Since the three-terminal joint connector can be made simply by the housing 110 having the movable lance 111 therein and the U-shaped spring 130, the bus bar becomes unnecessary, and only a small number of parts are required.

(5) By collecting the three terminals with the U-shaped spring 130 and applying load, the terminals can be simply brought into a contact state.

(6) Since the exclusive bus bar 103B (FIG. 18B) for three-terminal connection as in Patent Document 1 is not used, there is no concern about the knocking of the tab portions of the bus bar. (7) Since the inside of the housing 110 is a large internal space, the package insertion of the terminals becomes possible, and productivity is improved.

Embodiment 5: Four-Terminal Joint Connector

Figure 17:
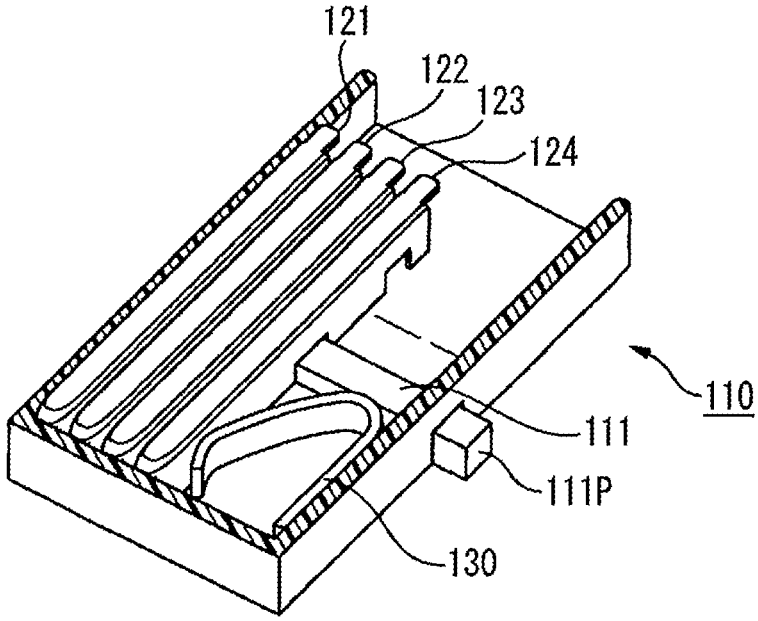
FIG. 17 is a cross-sectional perspective view showing a joint connector related to Embodiment 5 of the invention into which four terminals are assembled.

In Embodiment 5 of the invention, a joint connector that electrically connects four terminals can be made. FIG. 17 shows an embodiment of a joint connector that electrically connects four terminals. First, if the movable lance 111 is first made to retreat from the bottom 110B of the housing 110 as described in FIG. 13, four terminals 121 to 124 are then collectively or sequentially accommodated within the housing 110 in the manner described in FIG. 14, the spring 130 is accommodated within the housing 110 in the manner described in FIG. 15, and the movable lance 111 is returned to the bottom 110B of the housing 110 as described in FIG. 16, a four-terminal accommodating joint connector is simply obtained.

Embodiment 6: n-Terminal Joint Connector

In Embodiment 6 of the invention, a joint connector that electrically connects n terminals can be made similarly. That is, if the movable lance 111 is first made to retreat from the bottom 110B of the housing 110 as described in FIG. 13, n terminals 121 to 12*n* are then collectively or sequentially accommodated within the housing 110 in the manner described in FIG. 14, the spring 130 is accommodated within the housing 110 in the manner described in FIG. 15, and the movable lance 111 is returned to the bottom 110B of the housing 110 as described in FIG. 16, a n-terminal accommodating joint connector is simply obtained. This is enabled by using a spring that can sufficiently and collectively press two terminals to n terminals toward the side wall of the housing even in all cases.

CONCLUSION (1) As such, according to the invention, since a plurality of terminals is inserted into a wide space with no hindrance inside the housing, the insertion force when the terminals are accommodated within the housing is reduced (making the insertion force low).

(2) As for the plurality of terminals accommodated in the housing, since the movable lance enters the recesses formed at the lower portions of the respective terminals, the terminals once accommodated in the housing no longer slip out toward the terminal insertion slot side (slip-out prevention).

(3) Since the barrel portions of the terminals hinder the returning operation of the movable lance in a state where at least one of the plurality of terminals is in an imperfect insertion state inside the housing, the movable lance cannot return and thereby, imperfect insertion of the terminal is simply ascertained (half-insertion state prevention).

(4) Since the joint connector of a plurality of terminals can be made simply by the housing having the movable lance therein and the U-shaped spring, the bus bar becomes unnecessary, and only a small number of parts are required (reduction in the number of parts).

(5) By collecting a plurality of terminals with the U-shaped spring and applying load, the terminals can be simply brought into a contact state (simple structure).

(6) Since an exclusive bus bar to be inserted into terminals is not used, there is no concern about knocking of tab portions of the exclusive bus bar (knocking prevention).

(7) Since the inside of the housing is a wide internal space where a plurality of terminals has no hindrance inside the housing, package insertion of the plurality of terminals becomes possible, and productivity is improved (improvement in productivity).

What is claimed is:

1. A joint connector comprising:

a plurality of terminals;

a housing having a space with a size such that the plurality of terminals is capable of being accommodated in a contact state in parallel, and a terminal insertion slot allowing the terminals inserted into the space to be laterally moved from a side of one side wall to an opposite side wall; and a spring interposed between a terminal close to the one side wall among the plurality of terminals accommodated in the space and the one side wall so as to press the plurality of terminals in a mutual contact state toward the opposite side wall.

2. The joint connector according to claim 1, wherein the terminal includes a concave portion at a lower portion thereof in side view, a locking member includes a long body with a convex cross-section that enters the concave portion, and the locking member is formed at a bottom of the housing so that, if the terminal is laterally moved in a state where the terminal is inserted into the space of the housing from the terminal insertion slot and abuts on a regulating surface of the housing, the locking member can enter the concave portion and the terminals can be laterally moved from an inner wall surface of the one side wall to an inner wall surface of the opposite side wall.

3. The joint connector according to claim 2, wherein a groove having almost the same width as a breadth of the terminal is formed along the one side wall at the bottom of the housing, the groove configured so that the terminal can be inserted into the housing via the groove.

4. The joint connector according to claim 3, wherein the regulating surface that regulates a position of a tip of the terminal is formed as an inner wall surface of a back wall of the housing.

5. A joint connector, comprising:

a plurality of terminals;

a housing having an internal space with a size such that the plurality of terminals is capable of being accommodated in a contact state in parallel, and a terminal insertion slot with a size allowing the terminals coupled to the internal space;

a movable lance formed at a bottom of the housing so as to be capable of retreating from the bottom of the housing and returning to the bottom; and a spring interposed between a terminal close to a one side wall among the plurality of terminals accommodated in the internal space and the one side wall so as to press the plurality of terminals in a mutual contact state toward an opposite side wall.

6. The joint connector according to claim 5, wherein the terminal includes a concave portion at a lower portion thereof in side view, the movable lance includes a convex portion having a convex cross-section that enters the concave portion, and the movable lance is formed at the bottom of the housing so that the convex portion of the movable lance can enter the concave portion of the terminal in a state where the terminal is inserted into the internal space of the housing from the terminal insertion slot and abuts on a regulating surface of the housing.

7. The joint connector according to claim 6, wherein the regulating surface that regulates a position of a tip of the terminal is formed as an inner wall surface of a back wall of the housing.

* * * * *